US007167132B2

(12) United States Patent
Tamaoka

(10) Patent No.: US 7,167,132 B2
(45) Date of Patent: Jan. 23, 2007

(54) SMALL ANTENNA AND A MULTIBAND ANTENNA

(75) Inventor: Hiroyuki Tamaoka, Tokyo (JP)

(73) Assignee: The Furukawa Electric Co., Ltd. (JP)

( * ) Notice: Subject to any disclaimer, the term of this patent is extended or adjusted under 35 U.S.C. 154(b) by 0 days.

(21) Appl. No.: 10/961,496

(22) Filed: Oct. 8, 2004

(65) Prior Publication Data

US 2005/0093751 A1 May 5, 2005

(30) Foreign Application Priority Data

Oct. 9, 2003 (JP) ..... 2003-351064

(51) Int. Cl.
*H01Q 1/24* (2006.01)

(52) U.S. Cl. ..... 343/702; 343/895

(58) Field of Classification Search ..... 343/700 MS, 343/702, 895

See application file for complete search history.

(56) References Cited

U.S. PATENT DOCUMENTS

| | | | | |
|---|---|---|---|---|
| 3,852,759 | A * | 12/1974 | Felsenheld et al. | 343/729 |
| 5,929,825 | A * | 7/1999 | Niu et al. | 343/895 |
| 6,856,286 | B1 * | 2/2005 | Farrar et al. | 343/700 MS |
| 2003/0080904 | A1 * | 5/2003 | Chen | 343/700 MS |

* cited by examiner

*Primary Examiner*—Tho Phan
(74) *Attorney, Agent, or Firm*—Cantor Colburn LLP

(57) ABSTRACT

A small antenna comprising: an antenna pattern consisting of: two linear conductor elements; a shorting element that electrically connects the two linear conductor elements and a dielectric in a predetermined shape that contains the antenna pattern therein; where the two linear conductor elements are arranged in parallel with each other, and one of the two linear conductor elements is used as a fed line element, while the other is used as a grounded line element.

15 Claims, 12 Drawing Sheets

Prior Art

SMALL ANTENNA AND A MULTIBAND ANTENNA

CROSS-REFERENCE TO RELATED APPLICATIONS

The present application claims priority to Japanese Patent Application No. 2003-351064 filed on Oct. 9, 2003, which is incorporated herein in its entirety.

BACKGROUND OF THE INVENTION

1. Field of the Invention

The present invention relates to technical fields of small antennas and multiband antennas capable of being incorporated into a handheld device.

2. Related Art

In recent years, handheld devices such as cellular phones have become widespread, and demands are strong for miniaturization of the handheld devices. In particular, miniaturization of an antenna utilized by a handheld device is required, and techniques become important for providing a small antenna capable of being integrated into a handheld device. Although a planar antenna can be adopted as an antenna for a handheld device, a bandwidth strongly depends on the antenna size, and the size of the planar antenna is increased to support a wide band. Therefore, the miniaturization of the handheld devices is difficult. Accordingly, a wire antenna comprised of a linear conductor is generally adopted as an antenna for a handheld device. For example, as shown in FIG. 16, there is an example that linear patterns 101 having fold patterns are used as a monopole antenna. Such a wire antenna is suitable for miniaturization of the antenna itself.

However, in the example as shown in FIG. 16, in the case where the linear patterns 101 are disposed in an upper space on a circuit board 102 as a ground plate and the antenna is fed at a feeding point, it is necessary to reserve a distance from the circuit board 102 and metal parts to the linear patterns 101 to some extent. Therefore, the wire antenna shown in FIG. 16 needs wasteful spaces in the upper portion on the circuit board 102, and though the antenna itself is miniaturized, it is not suitable for use in an incorporated antenna in a handheld device.

In particular, a quarter-wave wire antenna functions as a dipole antenna as a whole by forming an image current on the ground plate. In this case, as the antenna is reduced in size, increased is contribution of radio wave radiated by the ground plate. Accordingly, when such an antenna is incorporated into a handheld device, holding the handheld device by hand directly affects the antenna, and antenna characteristics may deteriorate. Further, when a housing of the handheld device is a folder type, opening and closing the housing are equivalently changes in shape of the ground plate. Therefore, in an antenna incorporated into such a housing, antenna characteristics vary largely depending on whether the housing is opened or closed.

Further, when either the conventional planar antenna or wire antenna is used to constitute a multiband antenna allowing the use of a plurality of frequencies, the antenna size is large, it is difficult to adjust resonance frequencies to prescribed frequencies respectively, and it is difficult to ensure excellent antenna characteristics for all of the plurality of frequencies.

SUMMARY OF THE INVENTION

It is an object of the present invention to constitute an antenna with a small size and wide band by combining linear conductor elements, and provide a small antenna which is resistant to effects of a hand, etc. to ensure excellent antenna characteristics even when the antenna is incorporated into a handheld device, and is suitable for miniaturization.

It is another object of the present invention to provide a multiband antenna which enables easy adjustment of resonance frequencies to prescribed frequencies and ensures excellent antenna characteristics for each resonance frequency when the antenna is shared by a plurality of frequencies, is suitable for reduction in antenna size, and enables reduction in manufacturing cost.

An aspect of the present invention is a small antenna comprising: an antenna pattern consisting of: two linear conductor elements having two edges, one of which being one end, and the other of which being the other end, respectively; a shorting element that electrically connects said two linear conductor elements in respective predetermined positions between their said one ends and their said other ends; a dielectric in a predetermined shape that contains said antenna pattern therein; where said two linear conductor elements are arranged in parallel with each other, in approximately the same directions from their said one ends to their said other ends, and one of said two linear conductor elements is used as a fed line element connected to a feeding point, while the other is used as a grounded line element connected to ground.

According to the present invention, since an antenna pattern is formed of three linear conductor elements, it is possible to achieve miniaturization and wide band of an antenna as compared to conventional planar antennas. Further, a dummy plane is formed by arranging the fed line element and the grounded line element in parallel with each other in the dielectric, and an electric field (magnetic current) generated between the ground plate of the circuit board on which the antenna mounted and the antenna portion and the ground plate is used as a radiation source, thereby providing the antenna with resistance to effects of the ground plate. It is thus possible to ensure excellent antenna characteristics as compared to conventional wire antennas. As a result it is possible to achieve a small antenna that receives few adverse effects caused by holding the handheld device by hand.

In the small antenna of the present invention, the said dielectric may be mounted on a non-ground area in a corner of a circuit board including the ground pattern to connect said grounded line element.

According to the present invention, it is possible to remove the ground pattern of the circuit board, for example, in the shape of an "L" to mount the small antenna on the non-ground area of the circuit board, and it is thereby possible to easily achieve improvements in packaging in a handheld device and miniaturization while securing excellent antenna characteristics.

In the small antenna of the present invention, the grounded line element may be arranged leaving a predetermined space from the ground pattern in the vicinity of the non-ground area of said circuit board.

According to the present invention, the ground pattern of the circuit board and the grounded line element of the small antenna are disposed as kept adjacent with a predetermined space, and a portion (equivalent magnetic current slot) on which the electric field is concentrated is formed therein, and it is thereby possible to reduce effects of the ground plate as compared to the case that the entire circuit board radiates and prevent deterioration of antenna performance due to holding the handheld device by hand.

In the small antenna of the present invention, the fed line element and the grounded line element may be formed of conductor patterns with the same form having a predetermined width and a predetermined length.

According to the present invention, since it is possible to constitute an antenna pattern in a simple shape, it makes it easy to design a desired small antenna.

In the small antenna of the present invention, the fed line element and the grounded line element may be comprised of meander lines.

According to the present invention, the meander lines make it possible to constitute an antenna pattern with a long path length in a narrow space, and it is thus possible to achieve miniaturization of antennas having low resonance frequencies.

An aspect of the present invention is a multiband antenna comprising: a plurality of antenna patterns consisting of two linear conductor elements, one for a fed line element and the other for a grounded line element, which have two edges, one of which being one end, and the other of which being the other end, respectively, and are arranged in parallel with each other, in approximately the same directions from their said one ends to their said other ends; a pair of connecting elements that electrically connects said one ends or said other ends of said fed line elements and said grounded line elements, both of which two of said antenna patterns adjacent to one another consist; a dielectric in a predetermined shape that contains said fed line elements and said grounded line elements integrally connected by said connecting elements therein; where said plurality of antenna patterns are stacked in approximately the same directions from their said one ends to their said other ends, and each planes formed by said two linear conductor elements of said antenna patterns are approximately parallel to each other, and one of said plurality of antenna patterns is used as a fed layer, wherein said fed line elements are connected to a feeding point and said grounded line elements are connected to the ground at said one ends or said other ends on said fed layer, and said fed line elements and said grounded line elements are electrically connected by a shorting element at predetermined positions between said one ends and said other ends.

According to the present invention, since a plurality of antenna patterns is stacked and antenna patterns are connected sequentially to be integrated, the antenna can have a plurality of resonance, and a small-size multiband antenna can be provided.

In the multiband antenna of the present invention, an antenna pattern located in an uppermost portion among the plurality of antenna patterns may be set as said fed layer.

According to the present invention, concentration of electric field between a single layer and the ground plate is avoided by feeding and grounding in the uppermost antenna pattern, and balanced electric field is generated between each layer and the ground plate. By this means, it is possible to provide the multiband antenna having excellent characteristics for a plurality of resonance frequencies corresponding to path length.

In the multiband antenna of the present invention, the fed line elements and grounded line elements to be integrally connected may be connected in such a way that said plurality of antenna patterns are connecting sequentially downwardly starting with the upper side.

According to the present invention, an antenna is constituted such that antenna patterns are sequentially connected from the farthest antenna pattern to the nearest antenna pattern from the ground plane, the uniform electric field is thereby generated between each antenna pattern and the ground plate, and the antenna can have a plurality of resonance frequencies readily while maintaining excellent antenna characteristics.

In the multiband antenna of the present invention, said each pair of connecting elements may be disposed in positions such that do not overlap each other in the direction vertical to said antenna patterns According to the present invention, each pair of connecting elements formed between a plurality of antenna patterns configured in three dimension serve as radiation edges, and by arranging connecting elements apart from one another, it is possible to effectively prevent deterioration of antenna characteristics due to interference of electromagnetic field or the like.

In the multiband antenna of the present invention, said dielectric may be mounted on a non-ground area in a part of a circuit board including the ground pattern to connect said grounded line element.

According to the present invention, it is possible to mount the multiband antenna on non-ground area of the circuit board, and even in the case of using a plurality of frequencies, it is possible to avoid increases in antenna installation space.

In the multiband antenna of the present invention, said dielectric may have a multilayer structure such that N antenna patterns adapted to the use of N-band are stacked in N layers.

According to the present invention, it is possible to achieve the multiband antenna suitable for incorporating into a handheld device, using the dielectric with the multilayer structure.

An aspect of the present invention is a multiband antenna comprising: an antenna pattern adapted to the use of N-band and consisting of: two conductor patterns having two edges, one of which being one end, and the other of which being the other end, respectively; a shorting element that electrically connects said two conductor patterns in the position where are apart from their said one ends or their said other ends with a predetermined distance; a dielectric in a predetermined shape that contains said antenna pattern therein; where said two conductor patterns are arranged in parallel with each other, in approximately the same directions from their said one ends to their said other ends, and one of said two conductor patterns is used as a fed line connected to a feeding point, while the other is used as a grounded line connected to ground.

According to the present invention, even when the number of frequencies to be used increases, it is possible to adopt the configuration using the dielectric with the two-layer structure, and it is thus possible to achieve the multiband antenna which is suitable for miniaturization and enables its manufacturing in low cost.

DETAILED DESCRIPTION OF THE PREFERRED EMBODIMENTS

Preferred embodiments of the present invention will be described below with reference to accompanying drawings. Herein, as embodiments to which the present invention is applied, the first embodiment and the second embodiment are described. The first embodiment provides a small antenna corresponding to a single frequency using a single antenna pattern. The second embodiment provides a multi-band antenna that has a plurality of resonance frequencies using a plurality of antenna patterns.

Figure 1:
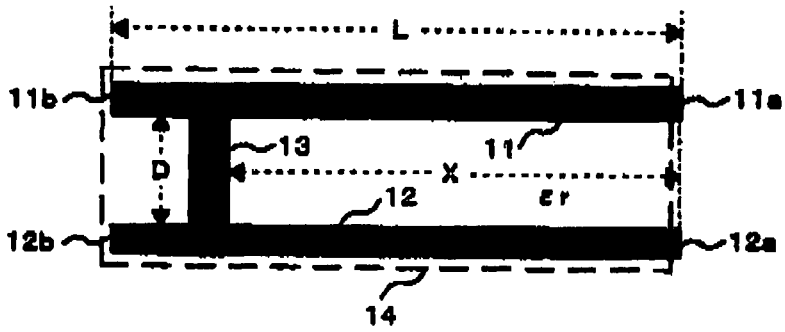
FIG. 1 shows an antenna pattern of a small antenna according to the first embodiment.
Figure 2:
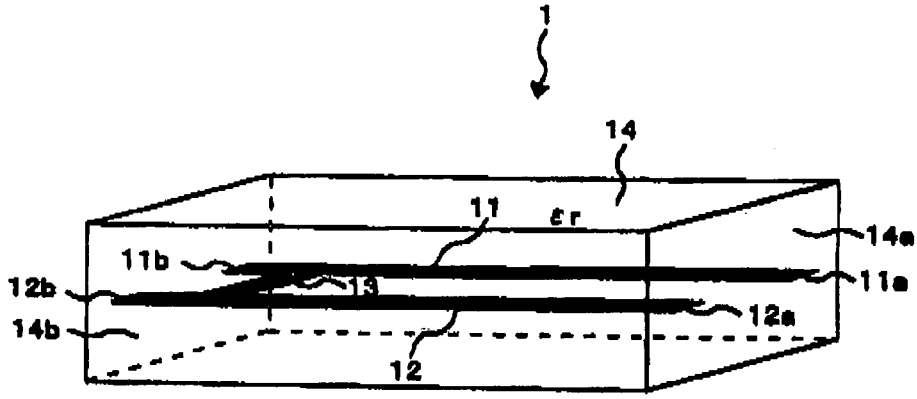
FIG. 2 is shows a three-dimensional structure of the small antenna according to the first embodiment.
Figure 3:
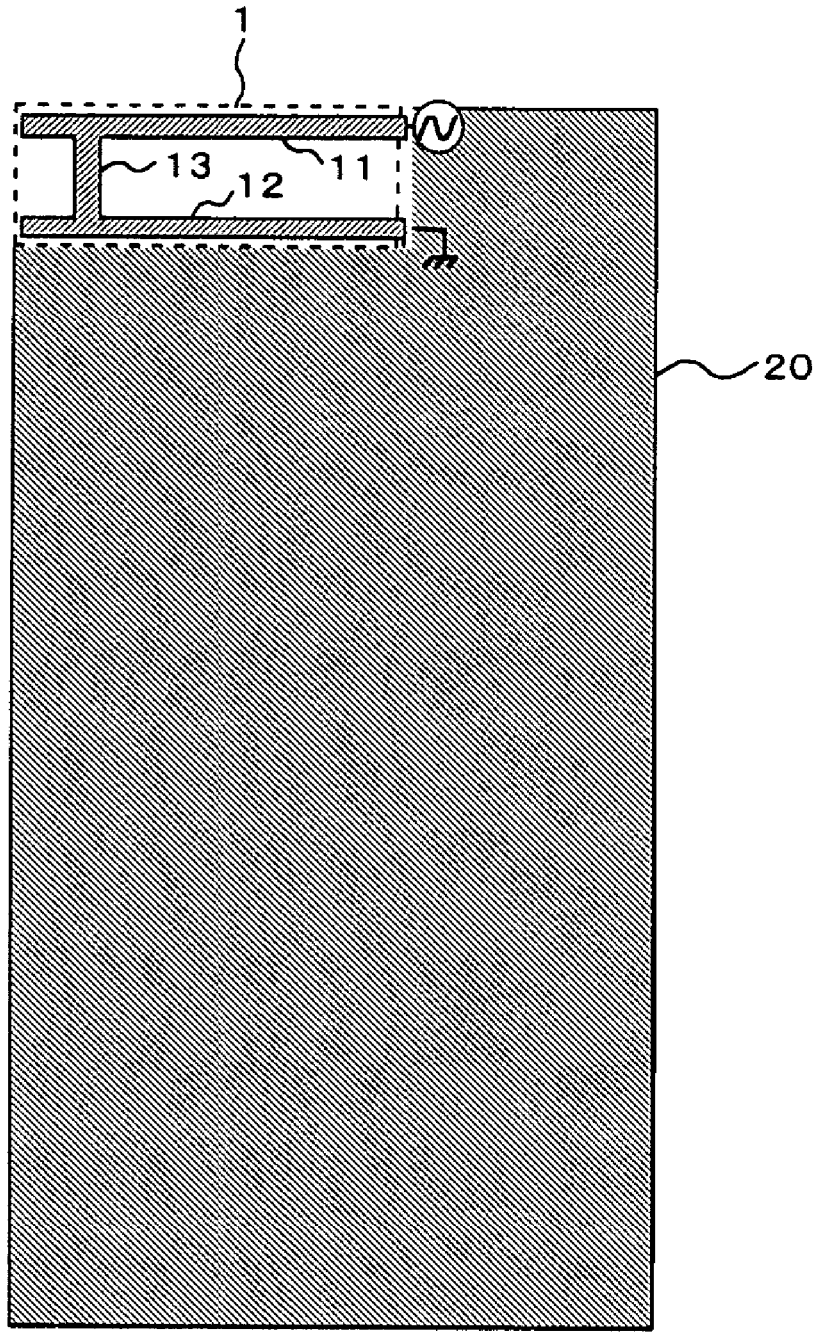
FIG. 3 shows an arrangement of the small antenna installed to a circuit board.

A structure of a small antenna according to the first embodiment will be described first with reference to FIGS. 1 to 3. FIG. 1 shows an antenna pattern of a small antenna 1 according to the first embodiment. FIG. 2 shows a three-dimensional structure of the small antenna 1. FIG. 3 shows the arrangement of the small antenna 1 installed to a circuit board.

As shown in FIG. 1, the small antenna 1 according to the first embodiment has a structure where an antenna pattern is configured that combines a fed line element 11, a grounded line element 12 and a shorting element 13, and contained in a dielectric 14.

The fed line element 11 is formed of a conductor pattern having an outer shape with a longitudinal length from one end 11*a* to the other end 11*b* and with a predetermined width, where the end 11*a* is connected to a feeding point, while the end 11*b* is opened. The grounded line element 12 is formed of a conductor pattern having an outer shape with a longitudinal length from one end 12*a* to the other end 12*b* and with a predetermined width, where the end 12*a* is connected to a ground terminal, while the end 12*b* is opened. The fed line element 11 and grounded line element 12 are the same as each other in the direction from the end 11*a*, 12*a* to the end 11*b*, 12*b*, respectively, and are arranged in parallel with a gap D.

In addition, in the example as shown in FIG. 1, the fed line element 11 and grounded line element 12 are formed of conductor patterns with the same shape and length L, and positions of ends 11*a* and 12*a* and positions of ends 11*b* and 12*b* are in accordance with one another in respective lateral directions. However, as long as the fed line element 11 and grounded line element 12 are substantially arranged in parallel, the conductors 11 and 12 are allowed to have different lengths and shapes. Further, the fed line element 11 and grounded line element 12 are allowed to have an arrangement that is slightly different from the parallel state.

Meanwhile, the shorting element 13 is formed of a conductor pattern that electrically connects the fed line element 11 and grounded line element 12. In the example in FIG. 2, the shorting element 13 is arranged in a position spaced a distance X apart from positions of the ends 11*a* and 12*a* respectively of the fed line element 11 and grounded line element 12. The shorting element 13 has a length equal to the gap D between the fed line element 11 and grounded line element 12. When the fed line element 11, grounded line element 12 and shorting element 13 are combined, an antenna pattern is formed integrally in the shape of an "H".

The resonance frequency of thus configured small antenna 1 is determined mainly depending on the length L of the fed line element 11 and grounded line element 12. For example, the length L can be set at a length of about one-fourth of the wavelength. Further, the impedance of the small antenna 1 can be adjusted mainly by varying the distance X between the ends 11*a*, 12*a* and the shorting element 13, while depending on the length (predetermined gap D) of the shorting element 13. In addition, the distance X can be adjusted optionally in a range with a position as a maximum that connects ends 11*b* and 12*b* respectively of the fed line element 11 and grounded line element 12.

Meanwhile, as shown in FIG. 2, the antenna pattern in FIG. 1 and dielectric 14 are united while dielectric 14 includes the antenna pattern, and serve as the small antenna 1 as a whole. The example as shown in FIG. 2 indicates the case of using the dielectric 14 which is formed of a dielectric material with a relative permittivity $\in r$ and has a rectangular parallelepiped outer shape comprised of six faces. The positions of ends 11*a* and 12*b* in the antenna pattern in FIG. 1 are disposed on the side face 14*a*, the positions of ends 11*b* and 12*b* are disposed on the side face 14*b*, and the antenna pattern is arranged in parallel with the upper face and the lower face of the dielectric 14. Herein, such a structure is obtained that the end 11*a* of the fed line element 11 and the end 12*a* of the grounded line element 12 protrude from the side face 14*a* of the dielectric 14. The structure is to enable the end 11*a* to be connected to the feeding point through the feeding terminal, and further enable the end 12*a* to be connected to a ground pattern through the ground terminal, outside the small antenna 1.

The small antenna 1 is mounted inside the handheld device in the arrangement as shown in FIG. 3. In FIG. 3, a circuit board 20 with a signal processing circuit and control circuit implemented thereon is installed inside the handheld device. The circuit board 20 has a non-ground area obtained by cutting part of the ground pattern in the upper corner of the circuit board 20, the small antenna 1 is mounted on the non-ground area on the circuit board 20, and thus the circuit board 20 and the antenna 1 are integrated. As shown in FIG. 3, the small antenna 1 is provided so that one face of the dielectric 14 is adjacent to the non-ground area in the corner of the circuit board 20. In addition, it is desirable that the non-ground area on the circuit board 20 is at least equal to or more than the antenna size of the small antenna 1. Further, to fix the small antenna 1 on the non-ground area on the circuit board 20, glue or a both side adhesive tape can be used. Furthermore, while manufacturing the small antenna 1, the circuit board 20 and the antenna 1 are integrated including a metallic terminal for the fixation, which is soldered to ground pattern of the circuit board 20, and the small antenna 1 can be fixed to the circuit board 20. In addition, it is desirable that when using the glue or the both side adhesive tape, its dielectric dissipation factor is not too big.

With the dielectric 14 thus disposed, a feeding element provided on the circuit board 20 is connected to the end 11*a* of the fed line element 11, while the ground pattern of the circuit board 20 is connected to the end 12*a* of the grounded line element 12. By this means, the small antenna 1 functions as a transmit antenna or a receive antenna of the handheld device with the circuit board 20 installed therein.

In the first embodiment, when the small antenna 1 is mounted inside the handheld device in the arrangement as shown in FIG. 3, the contribution of radiation due to the current flowing on the entire circuit board 20 is a little, and local radiation largely contributes in a portion where the small antenna 1 and the circuit board 20 are close to each other. Accordingly, as compared to conventional wire antennas, it is possible to reduce effects on antenna performance when the handheld device provided with the small antenna 1 according to the first embodiment is held by hand.

In addition, the electric field generated between the grounded line element 11 of the small antenna 1 and the ground pattern in the vicinity of the non-ground area on the circuit board 20 varies with the clearance between the grounded line element 11 and the ground pattern, and therefore, it is desirable to adjust the clearance so as to optimize antenna characteristics such as an antenna gain and band of the small antenna 1.

Figure 4:
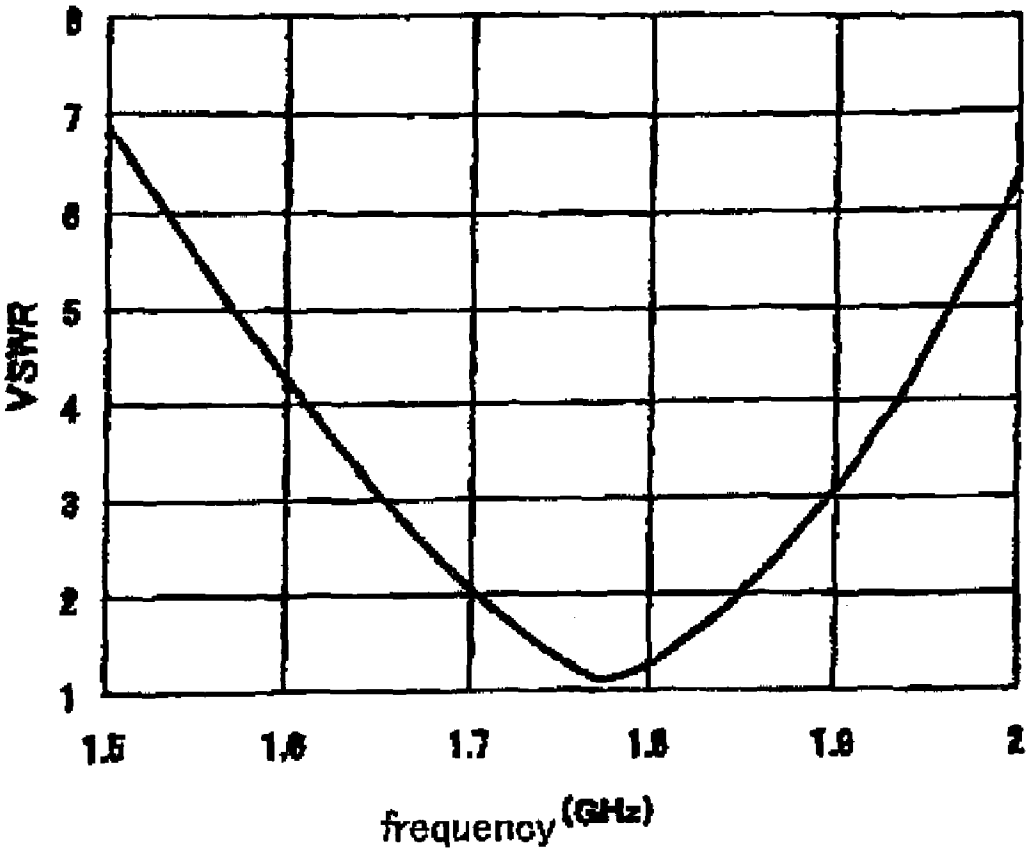
FIG. 4 shows the relationship of the VSWR to the frequency of the small antenna based on the design conditions in Table 1.
Figure 5:
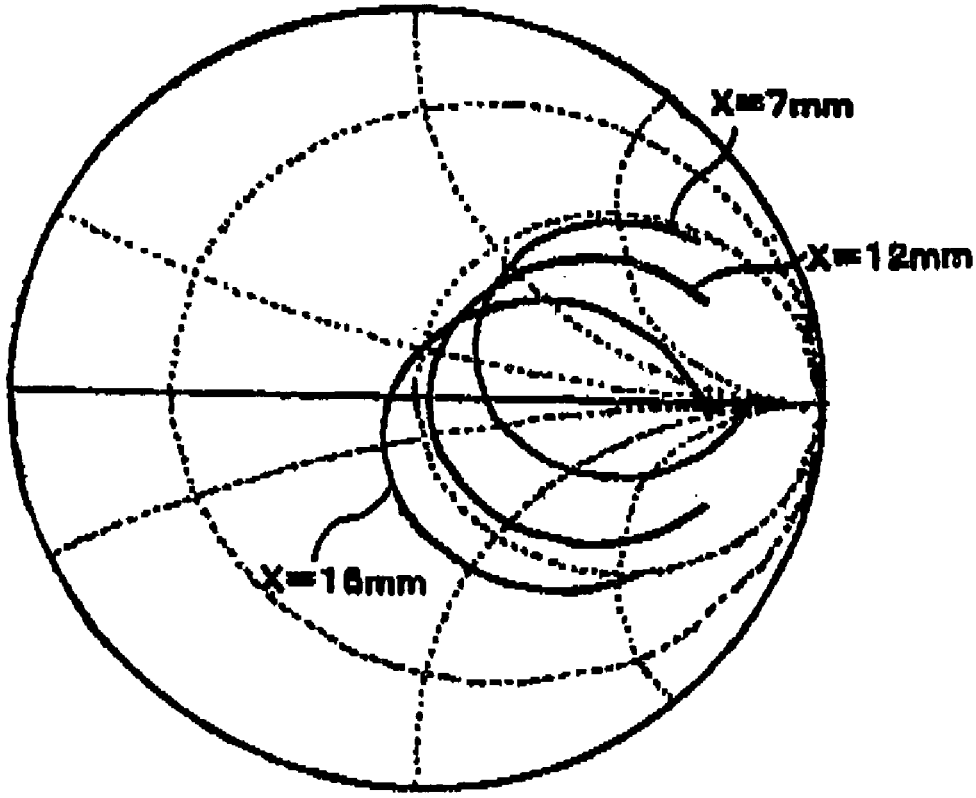
FIG. 5 shows the relationship between the position of the shorting element and the impedance of the small antenna 1 based on the design conditions in Table 1.
Figure 6:
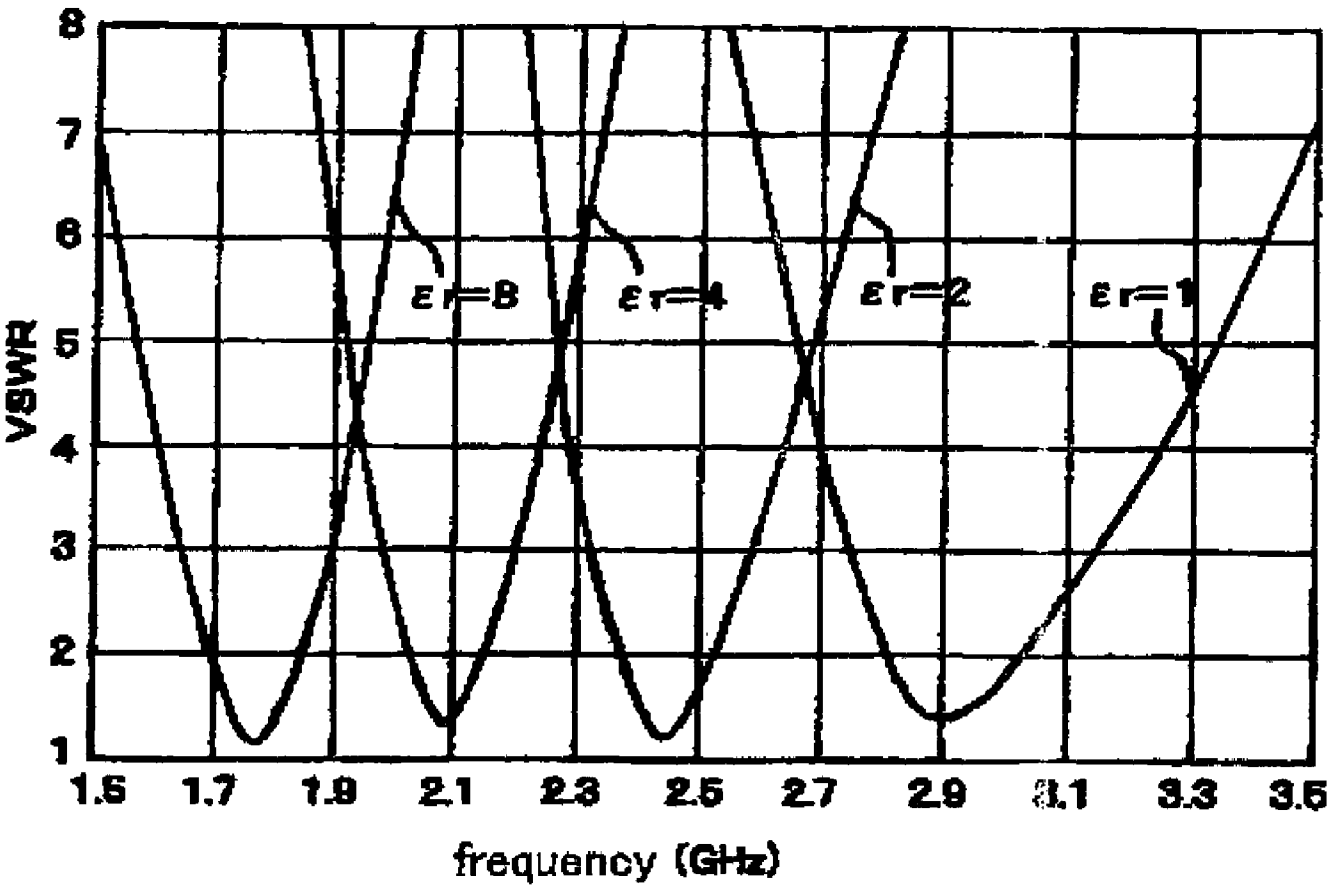
FIG. 6 shows the relationship of the VSWR to the frequency of the small antenna based on the design conditions in Table 1 in the case that the relative permittivity of the dielectric is changed.

The antenna characteristics of the small antenna 1 according to the first embodiment will be described below. Table 1 shows design conditions of the small antenna 1 assumed to be used in 1.8 GHz-band to simulate antenna characteristics. FIGS. 4 to 6 are views showing the antenna characteristics obtained in the case of performing a simulation using the small antenna 1 corresponding to the design conditions in Table 1.

TABLE 1

| Item | Design condition |
|---|---|
| Length L of each linear conductor | 18 mm |
| Gap D between the fed line element and grounded line element | 2 mm |
| Distance X from the ends position to shorting element | 16 mm |
| Width of each conductor | 1 mm |
| Space between the grounded line element and ground pattern | 0.5 mm |
| Relative permittivity $\epsilon r$ of the dielectric | 8 |

The distance X from the end 11*a*, 12*a* to the shorting element 13 was set that the impedance of the small antenna 1 is adapted to a transmission system of about 50 Ω.

FIG. 4 is a graph showing the relationship of the VSWR to the frequency of the small antenna 1 based on the design conditions in Table 1. In FIG. 4, variations in VSWR are shown in a frequency range from 1.5 to 2 GHz in the small antenna 1. According to this graph, VSWR is minimized in the frequency of about 1.8 GHz. The resonance frequency of the small antenna 1 is determined depending on the length L of the fed line element 11 and grounded line element 12 and on the relative permittivity of the dielectric 14. In the design conditions as shown in FIG. 4, the condition to produce resonance in 1.8 GHz corresponds to L=18 mm. At this point, decreasing the length L increases the resonance frequency of the small antenna 1, while increasing the length L decreases the resonance frequency of the small antenna 1.

Further, it is understood from FIG. 4 that the small antenna 1 secures a relatively wide band. For example, in a general planar antenna capable of being incorporated in a handheld device, the size of the planar antenna needs to increase to expand bandwidth. In contrast thereto, the small antenna 1 according to the first embodiment can expand bandwidth without increasing the antenna size, and in this respect, is superior.

Thus, the small antenna 1 according to the first embodiment is characterized in that the antenna 1 acts like the conventional planar antenna more than the conventional wire antenna. This is because a dummy plane is formed by causing in-phase currents on both the elements 11 and 12 due to electromagnetic field coupling between the fed line element 11 and grounded line element 12 in the antenna pattern, and the radiation characteristics are similar to those of a planar inverted F antenna.

FIG. 5 is a chart showing the relationship between the position of the shorting element 13 and the impedance among the antenna characteristics of the small antenna 1 based on the design conditions in Table 1. In FIG. 5, with respect to the small antenna 1, the distance X between the shorting element 13 and the end 11*a*, 12*a* is varied in three ways, and for each distance, variations in impedance are indicated on the smith chart in the same frequency range as in FIG. 4. According to FIG. 5, as the distance X is decreased, the impedance of the small antenna 1 gradually shifts toward upper right on the smith chart. Accordingly, by varying the distance X of the shorting element 13 as appropriate, impedance matching can be obtained, and matching of the small antenna 1 can be optimized independently of the resonance frequency as described above.

In FIG. 6, the relative permittivity $\in r$ of the dielectric 14 is changed to 1, 2, 4 and 8 in the small antenna 1 provided with the design conditions in Table 1, and for each relative permittivity, the relationship between the frequency and VSWR is graphed in the same way as in FIG. 4. It is understood from FIG. 6 that as the relative permittivity $\in r$ increases, the resonance frequency as a peak of VSWR decreases. Thus, the resonance frequency largely depends on the relative permittivity $\in r$ of the dielectric 14, and therefore, by selecting an appropriate dielectric material for use in the dielectric 14, it is possible to significantly reduce the size of the small antenna 1. In other words, the resonance frequency of the small antenna 1 can be adjusted by setting as appropriate the relative permittivity $\in r$, as well as the length L of the fed line element 11 and grounded line element 12.

As described above, in the design conditions of the small antenna 1 according to the first embodiment, it is necessary to determine each parameter associated with the antenna pattern, the relative permittivity $\in r$ of the dielectric 14, etc. so as to adapt to a used frequency band and impedance matching. In determining design conditions of the antenna pattern, for example, the length L is determined to adapt to a used frequency band, while the position of the shorting element 13 is determined to adapt to impedance matching, thus providing an advantage that each parameter can be adjusted independently.

Figure 7:
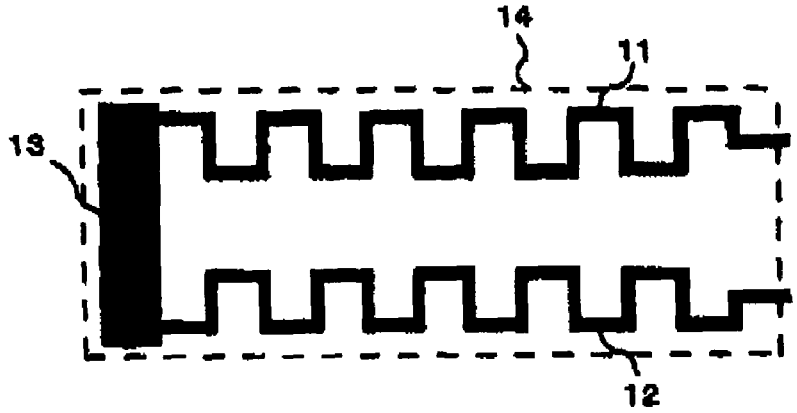
FIG. 7 shows a modification of the small antenna according to the first embodiment.

A modification of the small antenna 1 according to the first embodiment will be described below. FIG. 7 is a view showing the case where the fed line element 11 and grounded line element 12 are comprised of meander lines in the antenna pattern as shown in FIG. 1. In the modification as shown in FIG. 7, as compared to the structure in FIG. 1 with the same antenna size as that of the modification, it is possible to decrease the resonance frequency (increase the wavelength) corresponding to longer track length capable of being reserved by using the meander line. Further, in the case of using the same resonance frequency as in the structure in FIG. 1, adopting the modification in FIG. 7 decreases the length L in FIG. 1, and is suitable for miniaturization.

In addition, FIG. 7 shows the example where the shorting element 13 are disposed at the ends 11*b* and 12*b* respectively of the fed line element 11 and grounded line element 12, and also in this case, the position of the shorting element 13 is adjusted so that the impedance matching is optimized. Further, in FIG. 7, it may be possible to configure only one of the fed line element 11 and grounded line element 12 using the meander line. Also in this case, the position of the shorting element 13 is adjusted so that the impedance matching is optimized.

Figure 8:
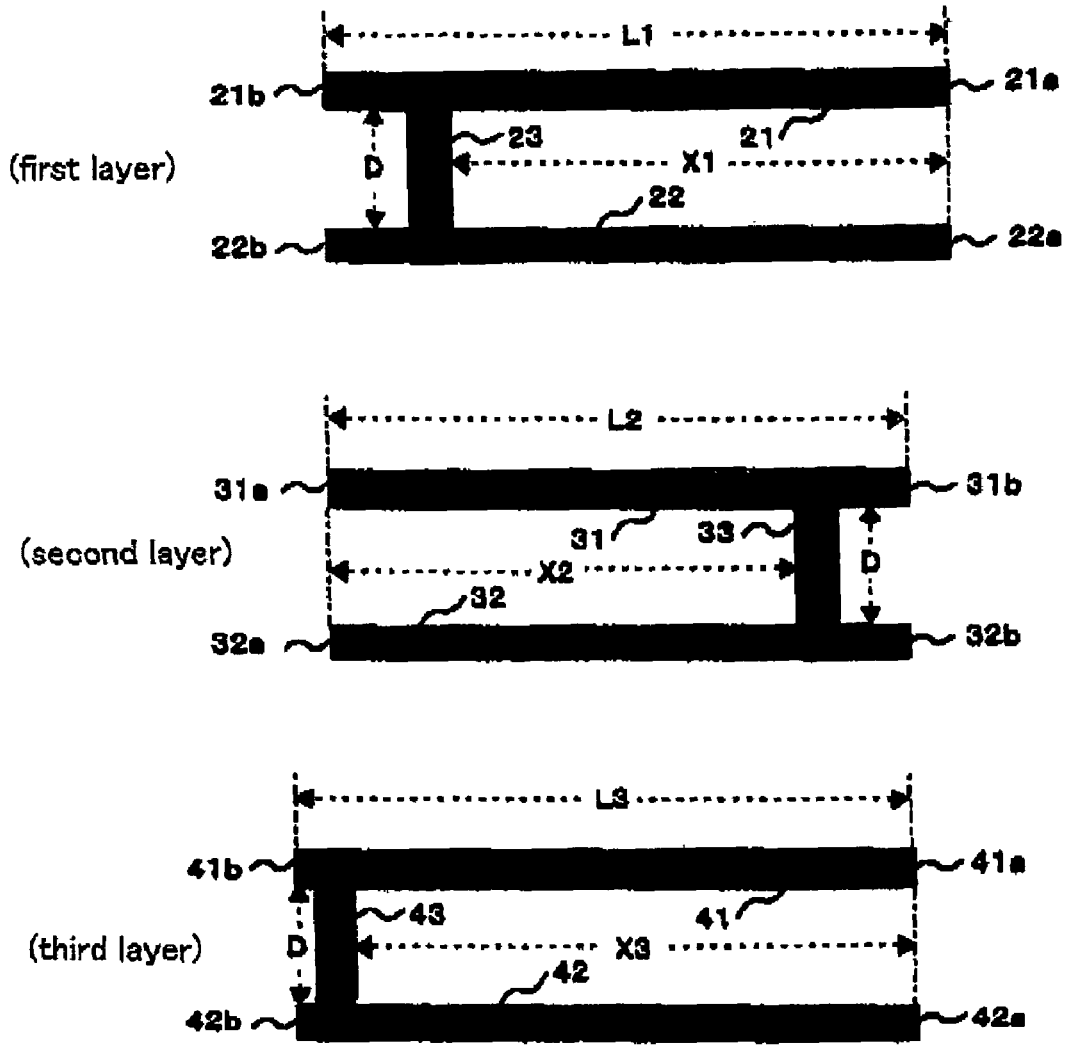
FIG. 8 shows each antenna pattern of a triple-band antenna according to the second embodiment.
Figure 9:
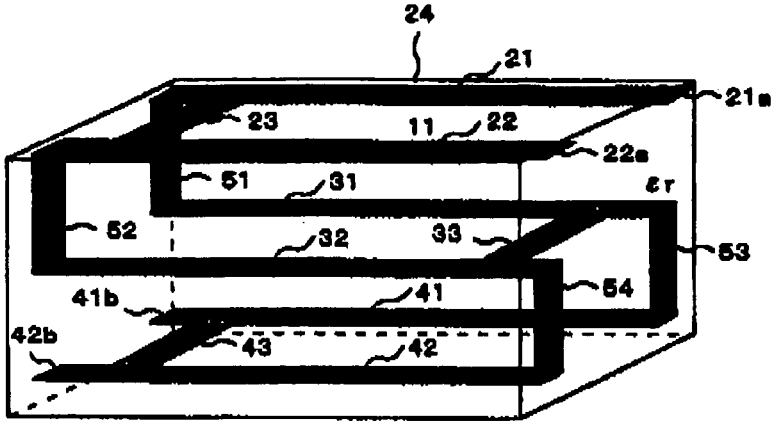
FIG. 9 shows a three-dimensional structure of the triple-band antenna according to the second embodiment.

A structure of a multiband antenna according to the second embodiment will be described below with reference to FIGS. 8 to 12. In the second embodiment, the case is described of constituting a multiband antenna with a multilayer structure enabling a plurality of different frequencies to be used based on the small antenna 1 according to the first embodiment. Herein, as an example of the multiband antenna, the case is explained where the present invention is applied to a triple-band antenna enabling three frequencies to be used. FIG. 8 is a view showing each antenna pattern that is a unit structure of a triple-band antenna 2 with a three-layer structure. FIG. 9 is a perspective view showing a three-dimensional structure of the triple-band antenna 2 comprised of antenna patterns shown in FIG. 7.

FIG. 8 shows an antenna pattern of a first layer (upper portion), an antenna pattern of a second layer (center portion), and an antenna pattern of a third layer (lower portion) of the triple-band antenna 2 with the three-layer structure. On the first layer are formed a fed line element 21 and grounded line element 22 each with a length L and a shorting element 23 with a distance X1, on the second layer are formed a fed line element 31 and grounded line element 32 each with a length L2 and a shorting element 33 with a distance X2, and on the third layer are formed a fed line element 41 and grounded line element 42 each with a length L3 and a shorting element 43 with a distance X3. In addition, on the first to third layers, fed line elements 21, 31 and 41 are arranged with a gap D from grounded line elements 22, 32 and 42, respectively. The structure of each antenna pattern is basically the same as in FIG. 1, except that the direction of each element on each layer, where the direction (right to left as viewed in the figure) on the first and third layers is the same as that in FIG. 1, while the direction (left to right as viewed in the figure) on the second layer is inverse to that in FIG. 1.

Meanwhile, as shown in FIG. 9, respective antenna patterns of layers in FIG. 8 are connected in three dimensions and integrally contained in a dielectric 24, thereby forming the triple-band antenna 2 with the three-layer structure. In FIG. 9, at one ends of antenna patterns on the first and second layers facing each other, the fed line element 21 on the upper side and the fed line element 31 on the lower side are electrically connected by a connecting element 51, while the grounded line element 22 on the upper side and the grounded line element 32 on the lower side are electrically connected by a connecting element 52. Similarly, at one ends of antenna patterns on the second and third layers facing each other, the fed line element 31 on the upper side and the fed line element 41 on the lower side are electrically connected by a connecting element 53, while the grounded line element 32 on the upper side and the grounded line element 42 on the lower side are electrically connected by a connecting element 54. Each of four connecting elements 51 to 54 is formed of a conductor pattern in the direction perpendicular to the plane of each of antenna patterns of three layers.

Then, at one end of the antenna pattern on the first layer, the end 21*a* of the fed line element 21 is connected to the feeding terminal, and the end 22*a* of the grounded line element 22 on the first layer is connected to the ground terminal, thereby enabling the operation as the triple-band antenna 2. In this way, in the triple-band antenna 2 with the three-layer structure, the antenna pattern in an uppermost position is set as a fed layer and targeted for feeding and grounding.

When viewed from the feeding point, an integrally connected conductor pattern is formed that starts from the end 21*a* of the fed line element 21 on the first layer and reaches the end 41*b* of the fed line element 41 on the third layer. Further, when viewed from the ground pattern, an integrally connected conductor pattern is formed that starts from the end 22*a* of the grounded line element 22 on the first layer and reaches the ground end 42*b* of the grounded line element 42 on the third layer. The both conductor patterns form a three-dimensional antenna pattern that passes through respective antenna patterns of three layers and has the fold shape.

In addition, in the example as shown in FIGS. 8 and 9, as the fed layer, the uppermost antenna pattern is targeted for feeding and grounding. It is thereby possible to avoid causing a large portion of electric fields to concentrate on a lower antenna pattern close to the ground pattern with the antenna mounted inside the handheld device, and to attain resonance frequencies almost close to the designed value. Further, in the example as shown in FIGS. 8 and 9, the integrally connected antenna pattern is formed which passes through three antenna patterns from the upper side to the lower side sequentially, and it is possible to change the connecting order.

Figure 10:
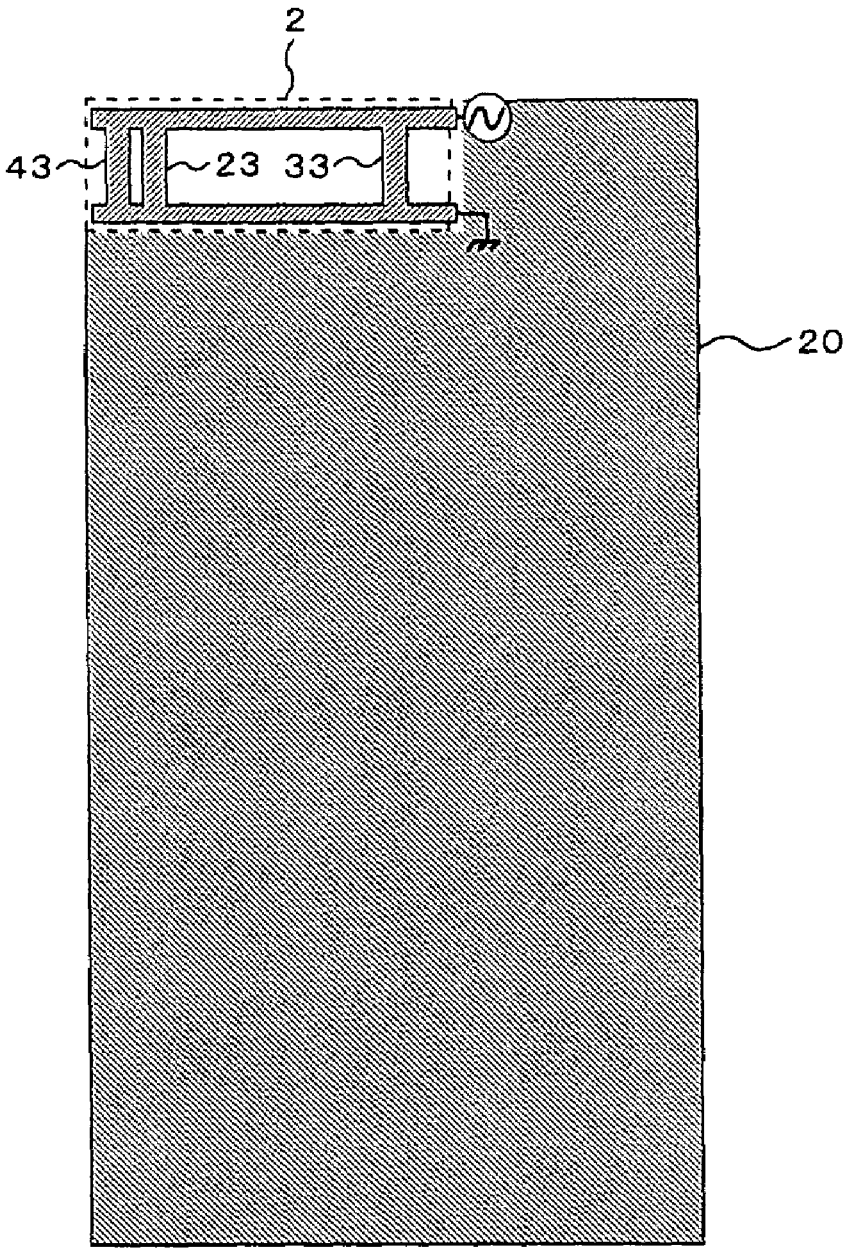
FIG. 10 shows an arrangement of the triple-band antenna to a circuit board.

The triple-band antenna 2 is mounted inside the handheld device in the arrangement as shown in FIG. 10. In FIG. 10, the shape of the circuit board 20 in FIG. 10 is the same shape as in the first embodiment, and the triple-band antenna 2 is mounted on the non-ground area on the circuit board 20 obtained by cutting part of the ground pattern in the corner of the circuit board 20. In this state, the feeding element provided on the circuit board 20 is connected to the end 21*a* of the fed line element 21 on the first layer, while the ground pattern on the circuit board 20 is connected to the end 22*a* of the grounded line element 22 on the first layer.

Figure 11:
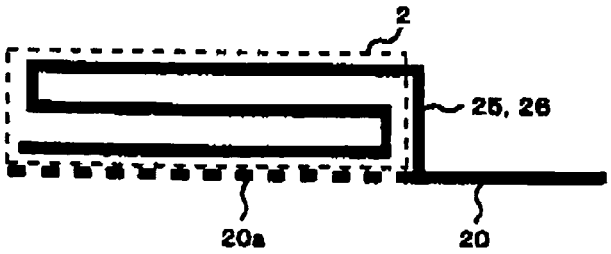
FIG. 11 is a side view of the triple-band antenna mounted inside the handheld device.

FIG. 11 is a side view of the triple-band antenna 2 mounted inside the handheld device as shown in FIG. 10. In FIG. 11, the triple-band antenna 2 placed on non-ground area 20*a* on circuit board 20 is mounted with the lower side lying directly on the circuit board 20. In this case, in the triple-band antenna 2, a space between the plane position of the circuit board 20 and each layer is increased in descending order of layer, i.e., the third layer, second layer and first layer. A feeding terminal 25 and a ground terminal 26 are provided which extend downwardly respectively from the fed line element 22 and the grounded line element 23 on the first layer, and are connected to respective predetermined positions on the circuit board 20. In addition, to fix the triple-band antenna 2 on the non-ground area on the circuit board 20, the same method can be used as for the small antenna 1 as described above.

Thus connected triple-band antenna 2 functions as a antenna capable of transmitting and receiving by three different resonance frequencies, fL, fM and fH (fL<fM<fH), used in the handheld device. For the highest frequency fH, connecting elements 51 and 52 serve as a radiation edge via the first-layer antenna pattern, and the frequency adjustment can be made by the length L1 of each element on the first layer. Further, for the middle frequency fM, connecting elements 53 and 54 serve as a radiation edge via the first-layer and second-layer antenna patterns, and the frequency adjustment can be made by the lengths L1 and L2 respectively of elements on the first and second layers. For the lowest frequency fL, two ends, 41*b* and 42*b*, serve as a radiation edge via the first-layer, second-layer and third-layer antenna patterns, and the frequency adjustment can be made by the lengths L1, L2 and L3 respectively of elements on the first to third layers.

Figure 12:
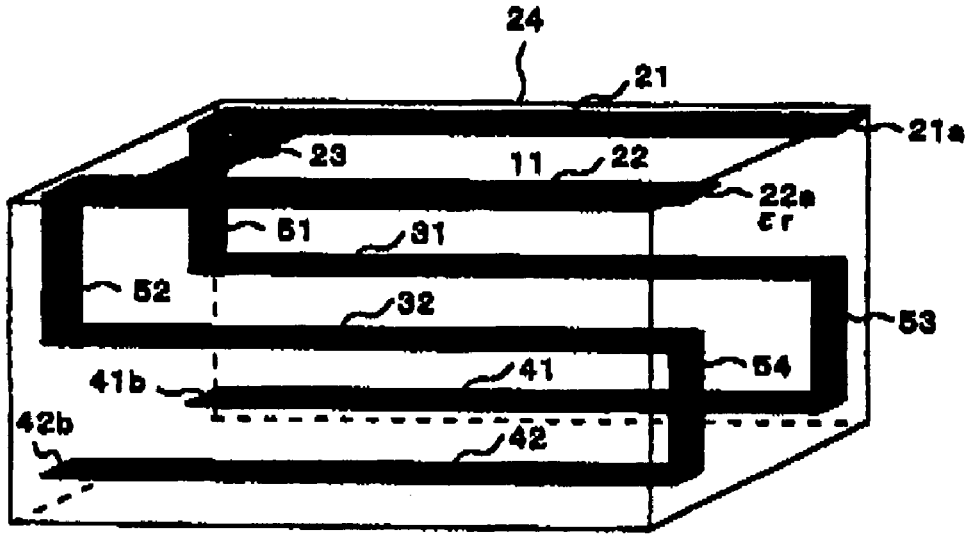
FIG. 12 shows an arrangement of the three-dimensional structure of the triple-band antenna in the case that the shorting element is only provided on the first-layer.

Meanwhile, impedance matching of the triple-band antenna 2 is dominantly affected by the distance X between the shorting element 23 and each end, 21*a* or 22*a*, of the fed layer(first-layer) for either of the three resonance frequencies fL, fM and fH. The second-layer shorting element 33 and third-layer shorting element 43 have slight effects on the impedance of the middle frequency fM and the lowest frequency fL, but are hard to adjust the impedance optionally. In this case, as shown in FIG. 12, it may be possible that the shorting element 23 is only provided on the fed layer (first-layer), without providing a shorting element on the other layers.

A specific design example of the triple-band antenna 2 according to the second embodiment will be described below. Table 2 shows design conditions of the triple-band antenna 2 on the assumption that the antenna is applied to a cellular phone with three functions, CDMA, GPS and PCS, and thus used for three frequencies, 900 Mz-band (CDMA), 1.575 GHz-band (GSP) and 1.8 GHz-band (PCS).

TABLE 2

| Item | Design condition |
|---|---|
| Length L1 of each line element on the first layer | 20 mm |
| Length L2 of each line element on the second layer | 15 mm |
| Length L3 of each line element on the third layer | 20 mm |
| Gap D between the fed line element and grounded line element | 1 mm |
| Space between layers | 1 mm |
| Width of each element | 1 mm |
| Space between each line element on the third layer and ground pattern of the circuit board | 0.5 mm |
| Relative permittivity $\epsilon r$ of the dielectric | 8 |

Figure 13:
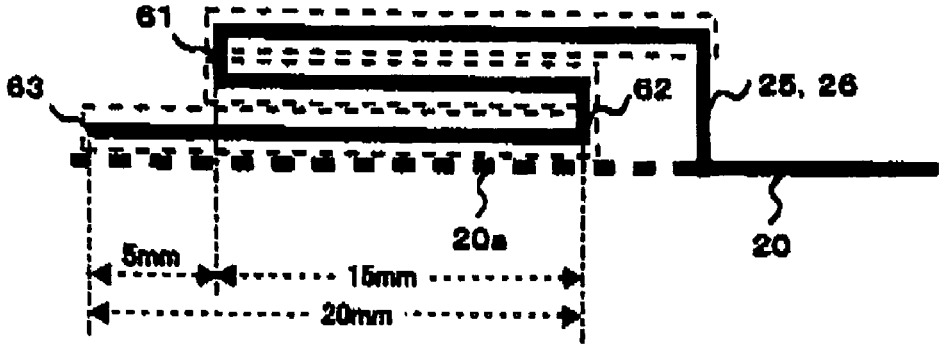
FIG. 13 is a side view of the triple-band antenna base on the design conditions shown in Table 2.

According to the design conditions as shown in Table 2, a specific shape and arrangement of the triple-band antenna 2 were set corresponding to the structure as shown in FIGS. 8 to 11. FIG. 13 is a side view of the triple-band antenna 2 corresponding to the design conditions shown in Table 2, as in FIG. 11. The triple-band antenna 2 as shown in FIG. 13 has a three-layer stacked structure formed of three antenna patterns adapted to the use of the three frequencies.

In such a structure, the connecting elements 51 and 52 on the first-layer antenna pattern function as a radiation edge 61 for the frequency band of 1.8 GHz, the connecting elements 53 and 54 on the second-layer antenna pattern function as a radiation edge 62 for 1.575 GHz, and the ends 41*b* and 42*b* on the third-layer antenna pattern function as a radiation edge 63 for 900 NHz. In addition, on the first-layer antenna pattern, the fed line element 21 is connected to the feeding terminal 25, while the grounded line element 22 is connected to the ground terminal 26, and the terminals 25 and 26 are connected to the feeding point and ground pattern on the circuit board 20 below, respectively.

Figure 14:
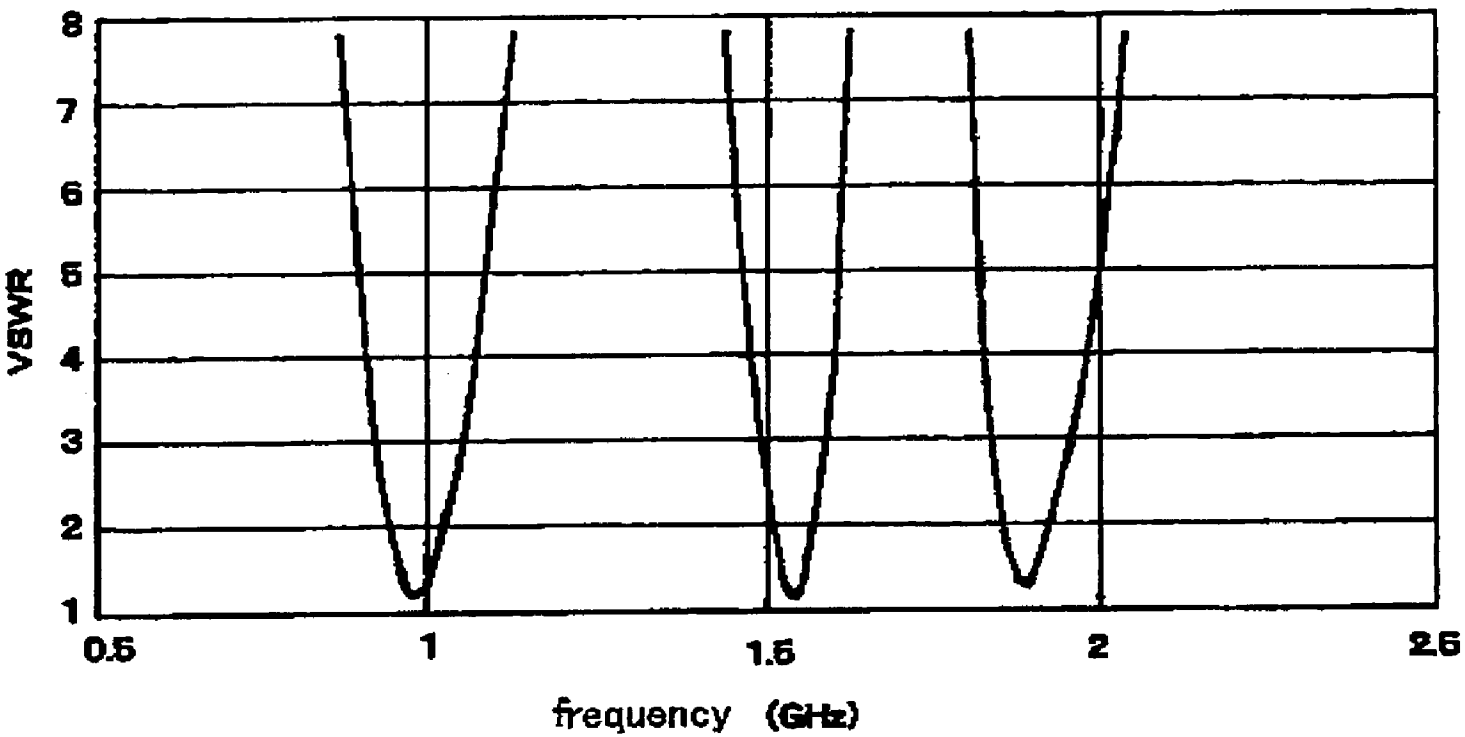
FIG. 14 shows the relationship of the VSWR to the frequency of the triple-band antenna based on the design conditions in Table 2.

FIG. 14 shows the relationship between the frequency and VSWR among antenna characteristics of the triple-band antenna 2 adapted to the design conditions in Table 2. In FIG. 14, variations in VSWR in a frequency range of 0.5 to 2.5 GHz are graphed in the triple-band antenna 2. According to the graph, local minimum points of VSWR appear in three frequencies, substantially, 900 MHz, 1.575 GHz and 1.8 GHz. By thus determining appropriate design conditions using the triple-band antenna 2 with the three-layer structure, it is possible to achieve antenna characteristics capable of transmitting and receiving by having three desired frequencies.

In FIG. 14, the bandwidth of the middle frequency fM is narrower than that of the lowest frequency fL or highest frequency fH. This is because as shown in FIG. 13, radiation edges 61 and 63 respectively of frequencies fH and fL exist in positions (left side as viewed in the figure) opposed to the ground pattern, the radiation edge 62 of the frequency fM exists in a position (right side as viewed in the figure) spaced apart from such a position, and the arrangements for frequencies fH and fL are relatively appropriate for wide band. Generally, CDMA and PCS require a wide band, while GPS does not need such a wide band. Therefore, it is desirable to configure the triple-band antenna 2 in the positional relationship as shown in FIG. 14.

Meanwhile, as shown in FIG. 13, these three radiation edges, 61, 62 and 63, are arranged in positions that do not overlap one another in the direction vertical to the antenna pattern. Specifically, the radiation patterns 61 and 62 are spaced 15 mm apart from one another, the radiation patterns 61 and 63 are spaced 5 mm apart from one another, and the radiation patterns 62 and 63 are spaced 20 mm apart from one another. When the three radiation edges 61, 62 and 63 are arranged adjacent to one another, the antenna characteristics deteriorate such as the antenna gain and band caused by mutual interference, of electromagnetic fields. Therefore, the radiation edges are spaced apart from one another to ensure excellent antenna characteristics for three frequencies.

Figure 15:
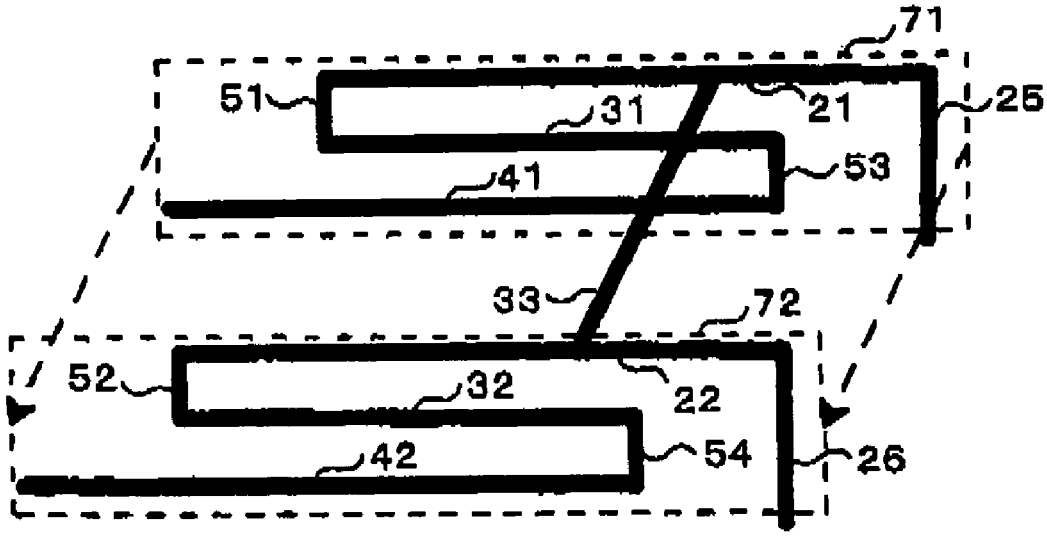
FIG. 15 is a side view of the case where the triple-band antenna based on the same design conditions as in FIG. 13 is configured in two-layer structure.
Figure 16:
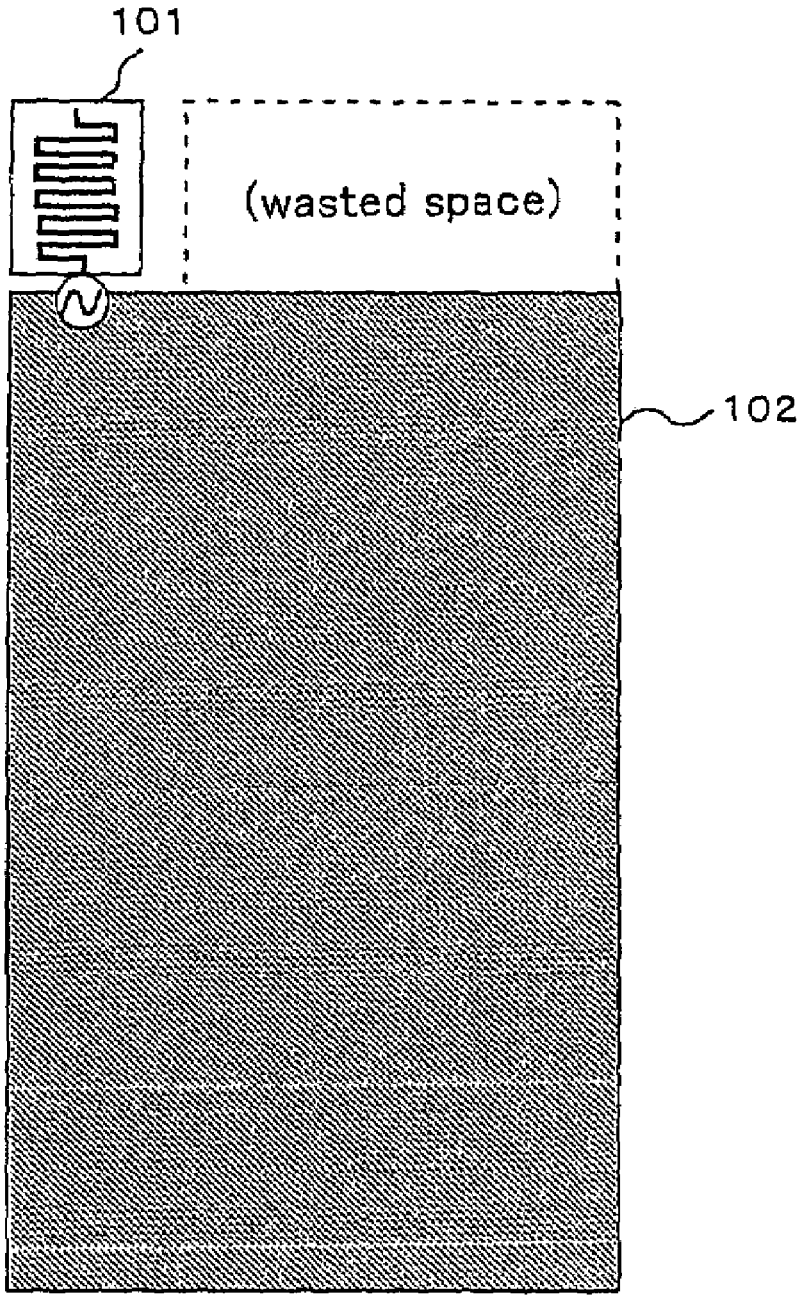
FIG. 16 shows an arrangement of the conventional monopole antenna installed to a circuit board.

In addition, in the example as described above, the case is described where three antenna patterns are formed on respective layers for the triple-band antenna 2 with the three-layer structure. Further, it is possible to implement the same constitution by substituting the two-layer structure equivalently. FIG. 15 is a side view of the case where the triple-band antenna 2 based on the same design conditions as in FIG. 13 is configured in two-layer structure. In FIG. 15, the entire antenna pattern is divided into a fed conductor pattern 71 and a grounded conductor pattern 72, and there is shown the triple-band antenna 2 including the patterns as two layers.

In the fed conductor pattern 71, fed line elements 21, 31 and 41 and connecting elements 51 and 53 are formed on one layer, among structural elements of the triple-band antenna 2 as shown in FIGS. 8 and 9. In the grounded conductor pattern 72, grounded line elements 22, 32 and 42 and connecting elements 52 and 54 are formed on the other layer, among structural elements of the triple-band antenna 2 as shown in FIGS. 8 and 9. Furthermore, the shorting element 33 is formed of a conductor pattern that electrically connects the fed line element 21 and grounded line element 22. When such a structure is applied to a multiband antenna, it is possible to always achieve the antenna in two-layer structure if the number of frequencies sharing the antenna increases, and to simplify the layer stacking process in manufacturing so as to reduce the cost.

The aforementioned second embodiment describes the case of the triple-band antenna 2 enabling three frequencies to be used, but the present invention is not limited to such a case, and applicable widely to an N-band antenna enabling N frequencies to be used.

As described above, according to the present invention, a small antenna is configured using a dielectric including therein an antenna pattern that combines a fed line element, grounded line element and shorting element, and mounted, for example, non-ground area on the circuit board, whereby it is possible to achieve a small antenna which is suitable for reducing the antenna size while enabling a wide band as compared to conventional planar antennas, suitable for being incorporated into a handheld device while being hardly affected by hand or the like as compared to conventional wire antennas, and enables excellent antenna characteristics to be ensured.

Further, according to the present invention, a plurality of antenna patterns each combining a fed line element and grounded line element is stacked and disposed, and the antenna patterns are integrally connected, whereby it is possible to secure excellent characteristics with ease in adjustments of a plurality of resonance frequencies, and achieve a multiband antenna advantageous for reductions in antenna size and in manufacturing cost.

The invention claimed is:

1. A small antenna comprising:

a dielectric in a predetermined three-dimensional shape, said dielectric having a first end and a second end;

an antenna pattern included within the volume of said dielectric, said antenna pattern including:

two linear conductor elements extending in parallel with each other, in approximately the same directions between the first and second ends of said dielectric; and a shorting element that electrically connects said two linear conductor elements mat respective predetermined positions between the first end and the second end;

wherein one of said two linear conductor elements is used as a fed line element to be connected to a feeding point, while the other is used as a grounded line element to be connected to ground.

2. A small antenna according to claim 1, wherein the fed line element and the grounded line element are formed of conductor patterns with the same form having a predetermined width and a predetermined length.

3. A small antenna according to claim 1, wherein the fed line element and the grounded line element are comprised of meander lines.

4. A multiband antenna comprising:

a plurality of antenna patterns including two linear conductor elements, one for a fed line element and the other for a grounded line element, which have two edges, a first end and a second end, respectively, and are arranged in parallel with each other, in approximately the same directions from said first ends to said second ends;

a pair of connecting elements that electrically connects said first ends or said second ends of said fed line elements and said grounded line elements, both of which two of said antenna patterns adjacent to one another consist;

a dielectric in a predetermined shape that includes said fed line elements and said grounded line elements integrally connected by said connecting elements therein;

wherein said plurality of antenna patterns are stacked in approximately the same directions from said first ends to said second ends, and each planes formed by said two linear conductor elements of said antenna patterns are approximately parallel to each other, and one of said plurality of antenna patterns is used as a fed layer, wherein said fed line elements are connected to a feeding point and said grounded line elements are connected to the ground at said first ends or said second ends on said fed layer, and said fed line elements and said grounded line elements are electrically connected by a shorting element at predetermined positions between said first ends and said second ends.

5. A multiband antenna according to claim 4, wherein antenna pattern located in an uppermost portion among said plurality of antenna patterns is set as said fed layer.

6. A multiband antenna according to claim 5, wherein said fed line elements and grounded line elements to be integrally connected are connected in such a way that said plurality of antenna patterns are connecting sequentially downwardly starting with the upper side.

7. A multiband antenna according to claim 4, wherein said each pair of connecting elements are disposed in positions such that do not overlap each other in the direction vertical to said antenna patterns.

8. A mutiband antenna according to claim 4, wherein said dielectric is mounted on a non-ground area in a part of a circuit board including the ground pattern to connect said grounded line element.

9. A mutiband antenna according to claim 4, wherein said dielectric has a multilayer structure such that N antenna patterns adapted to the use of N-band are stacked in N layers.

10. A multiband antenna comprising:

a dielectric in a predetermined shape, said dielectric having a first end and a second end; and an antenna pattern adapted to the use of N-band, and included in said dielectric, said antenna including:

two conductor patterns arranged in parallel with each other, said two conductor patterns each having:

a plurality of conductor elements extending in parallel with each other in approximately the same direction between the first and second ends of the dielectric; and a pair of connecting elements that electrically connects ends of the linear conductor elements such that said plurality of conductor elements and said pair of connecting elements together form a single line element, wherein one of the two conductor elements serves as a fed line element and the other conductor element serves as a ground element; and a shorting element that electrically connects said two conductor patterns in the position apart from the first and second ends with a predetermined distance.

11. A multiband antenna comprising:

a dielectric in a predetermined shape, said dielectric having a first end and a second end; and an antenna patterns included in said dielectric, said antenna patterns including:

a plurality of pairs of two linear conductor elements extending in parallel with each other in approximately the same directions between the first and second ends of the dielectric, said plurality of pairs being layered such that each layer defined by the two linear conductor elements of one pair is parallel to the other layer defined by the two linear conductor elements of the other pair;

a pair of connecting elements that electrically connects ends of the two linear conductor elements in one layer to ends of the two linear conductor elements of a neighboring layer such that said plurality of pairs of linear conductor elements and said pair of connecting elements together form a single fed line element and a single ground line element that are parallel to each other; and at least one shorting element formed in at least one of the layers, said at least one shorting element being configured to connect the two linear conductor elements in the at least one layer at respective predetermined positions between the first and second ends of said dielectric.

12. A mounting structure of antenna, said structure comprising:

a small antenna including:

a dielectric in a predetermined shape, said dielectric including a first end and a second end;

an antenna pattern included in said dielectric, said antenna pattern including two linear conductor elements extending in parallel with each other in approximately the same directions between the first and second ends of said dielectric; and a shorting element that electrically connects said two linear conductor elements at respectively predetermined positions between the first end and the second end; and a circuit board including a feeding point and a ground pattern, said circuit board having a non-ground area formed in a corner thereof, wherein said dielectric is mounted on the non-ground area such that the two linear conductor elements are parallel to a longer edge of the corner wherein one of said two linear conductor elements is connected to the feeding point of said circuit board to serve as a fed line element, while the other is connected to the ground pattern of said circuit board to serve as a grounded line element.

13. The mounting structure according to claim 12, wherein said dielectric is mounted on the non-ground area so that said grounded line element faces the longer edge of the corner leaving a predetermined space between said grounded line element and the ground pattern.

14. The mounting structure according to claim 12, wherein the fed line element and the grounded line element are formed of conductor patterns with the same form having a predetermined width and a predetermined length.

15. The mounting structure according to claim 12, wherein the fed line element and the grounded line element are comprised of meander lines.

* * * * *